US007507123B2

(12) United States Patent
Kleber

(10) Patent No.: US 7,507,123 B2
(45) Date of Patent: Mar. 24, 2009

(54) CONTACTING APPLIANCE AND CONTACTING ARRANGEMENT FOR MOBILE ELECTRICAL DEVICES

(75) Inventor: Michael Kleber, Eslarn (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 12/074,397

(22) Filed: Mar. 4, 2008

(65) Prior Publication Data

US 2008/0227336 A1 Sep. 18, 2008

(30) Foreign Application Priority Data

Mar. 12, 2007 (DE) ..... 10 2007 011 821

(51) Int. Cl.
*H01R 24/00* (2006.01)

(52) U.S. Cl. ..... 439/626

(58) Field of Classification Search ..... 439/259, 439/289, 310, 297, 626; 320/107, 112, 114, 320/115

See application file for complete search history.

(56) References Cited

U.S. PATENT DOCUMENTS

| | | | | |
|---|---|---|---|---|
| 5,256,954 | A * | 10/1993 | Chen | 320/110 |
| 5,888,087 | A * | 3/1999 | Hanson et al. | 439/374 |
| 6,356,053 | B1 * | 3/2002 | Sandoz et al. | 320/115 |
| 6,583,600 | B2 * | 6/2003 | Haga et al. | 320/110 |
| 2003/0085685 | A1 * | 5/2003 | Usui et al. | 320/112 |
| 2003/0085686 | A1 * | 5/2003 | Haga et al. | 320/112 |
| 2004/0145341 | A1 * | 7/2004 | Fukushima | 320/107 |
| 2004/0251873 | A1 * | 12/2004 | Simoes et al. | 320/114 |
| 2005/0083013 | A1 * | 4/2005 | Zick et al. | 320/114 |

FOREIGN PATENT DOCUMENTS

| | | | |
|---|---|---|---|
| DE | 4316303 | A1 | 11/1994 |
| DE | 10106221 | A1 | 8/2002 |
| DE | 10307752 | A1 | 8/2004 |
| DE | 10344365 | A1 | 5/2005 |
| DE | 102005018004 | A1 | 10/2006 |
| EP | 0325458 | B1 | 3/1992 |

OTHER PUBLICATIONS

German Office Action dated Apr. 8, 2008 for DE 10 2007 011 821. 1-34 with English translation.

* cited by examiner

*Primary Examiner*—T C Patel
*Assistant Examiner*—Vladimir Imas
(74) *Attorney, Agent, or Firm*—Brinks Hofer Gilson & Lione

(57) ABSTRACT

The contacting appliance for temporarily establishing an electrically conductive contact is described, in particular a charging device for electrical devices. The appliance includes an accommodating entity which can be moved between at least two end locations, so that an electrical contact which is associated with the accommodating entity executes movements relative to a placement position or an insertion position of the mobile electrical device as a result of movements of the accommodating entity between the end locations. When the device is inserted into the contacting appliance, movement of the contact of the device relative to the contact of the accommodating entity is avoided.

19 Claims, 2 Drawing Sheets

CONTACTING APPLIANCE AND CONTACTING ARRANGEMENT FOR MOBILE ELECTRICAL DEVICES

This application claims the benefit of German patent application DE 10 2007 011 821.1, filed on Mar. 12, 2007, which is incorporated herein by reference.

TECHNICAL FIELD

The present application relates to a contacting appliance and contacting arrangement for mobile electrical devices having at least one contact pair at the electrical device and an apparatus accommodating the same

BACKGROUND

Contacting appliances are known in numerous variants, as in the case of charging stations for battery-operated mobile electrical devices. For the purpose of charging the battery in the electrical device, charging contacts must ensure a reliable electrical contact between device and charging station. However, this electrical contact must also be reliably provided over a multiplicity of charging operations and over a long service life of the electrical device.

In the case of many electrical devices, it is essential that they function without interruption and reliably over a long period of use, for example, where such devices that are used in the medical field. One example of these are so-called X-ray detectors in which a matrix-type sensor surface that is sensitive to X-ray radiation and has a multiplicity of regularly arranged sensor areas is disposed in a housing. The functionality of such electronic X-ray detectors is described in DE 101 06 221 A1 and in DE 103 07 752 A1.

DE 103 44 365 A1 discloses an X-ray detector having a battery which is arranged in the housing and provides the energy supply during mobile use and a send/receive unit for wireless signal transmission to an analysis unit. In addition, the detector can also have an interface for cable-based data transmission.

Other mobile X-ray detectors including batteries for energy supply are disclosed in DE 10 2004 048 21 A1 and DE 10 2005 018 004 A1.

In the case of such mobile X-ray detectors and other mobile devices having batteries for energy supply, the batteries must be regularly connected to a charging station in order to be recharged. In particular, following lengthy use and a multiplicity of contact mating operations, wear effects can occur and result in the batteries not being fully charged or no effective electrical contact being established.

For the purpose of establishing electrical contact between mobile X-ray detectors and associated charging stations, electrical drives are sometimes used. As a result of putting or inserting the detector into the charging station, a switch is activated in the end position and forwards a signal to the drive. The charging contacts are then extended by means of a motor and the connection is established between charging device and contact surfaces of the detector.

SUMMARY AND DESCRIPTION

A contacting appliance for temporarily establishing an electrically conductive contact is disclosed. An accommodating entity has at least one electrical contact which, depending on placement or insertion positions for the device to be contacted, can be moved between at least two end locations. The relative movements of the at least one electrical contact may be oriented obliquely or substantially perpendicularly with respect to the insertion-motion-direction of the device to be contacted. A corresponding contacting arrangement for mobile electrical devices includes at least electrical contact at the electrical device, facing a contact of the accommodating entity. In a first placement position of the electrical device at the accommodating entity, the contacts are arranged opposite to each other and may touch each other in a manner which is electrically conductive. In a second insertion position of the device in the accommodating entity the contacts are pressed together by pretension.

Abrasive movement of the contact pair or contact pairs is largely avoided, since the facing contacts are pushed together and pressed together by using a resilient force after contacting. Sliding movements of the contacts against each other, with the risk of material wear following a lengthy period of use, are substantially avoided.

The first insertion position is such that the mobile electrical device is brought close to the accommodating entity and only lightly placed in a correct placement position. The second insertion position is such that the electrical device is pushed or pressed against the return force of a spring or similar forcer during the movement from the first placement position into the second position or end location, which may also be also referred to as second insertion position. Contacting may have already been established at the first placement position. As a result of the light touch of the contacts, this contact may not be y reliable enough for a lengthy charging operation and the mobile device is moved into the second insertion position. In the second insertion position, the facing contacts are pressed together with sufficient force that a reliable electrical contact is established having a sufficient contact dependability for a charging operation of a battery situated in the electrical device, or for a data transmission from or to the electrical device.

In an aspect, during the transition from the first position to the second position, the facing contact surfaces of the contact pair meet each other in a manner which is substantially without relative movement, such that wear-inducing sliding and abrading movements of the contacts against each other are minimized. The contact may take place perpendicularly relative to a contact surface, with a subsequent increase of a contacting force as the contacts are pressed together. The contacts may be coated with a material that is resistant to oxidation, such as a thin film of silver or gold.

In another aspect, at least one contact of the accommodating entity is assigned to a sliding structure which defines a first end location in the first placement position of the device and a second end location in the second insertion position of the device. The sliding structure may be closer to the device in the second end location than in the first end location. The sliding device may slide, between first and second end locations on a sliding plane which may be inclined relative to the device position. The sliding structure ensures that the device may be held securely in the second insertion position, without the need for abrasive movements of the contacts against each other during the insertion step. The contact or the contacts of the accommodating entity, which may be, for example, a so-called base station or charging station or the like, may be assigned to the sliding structure or arranged therein. This sliding structure may be coupled to the mobile device such that, when the device is inserted, said sliding structure is pushed parallel with the device and, with the aid of the inclined sliding plane, the sliding structure is pushed in a perpendicular direction relative to the device and the contacts thereof. As a result of this relative movement perpendicular to the device, the contact pairs are pressed together.

Provision may be made for a forcer (pre-tensioner) to be arranged between at least one contact of the accommodating entity and the sliding structure, so that the forcer presses the contact of the accommodating entity against the contact of the mobile or portable device when the sliding structure is in the second end location. After the perpendicular relative movement of the mobile electrical device relative to the accommodating entity having the sliding structure, the contacts are held against each other by an applied force. The forcer may be a spring, in particular a compression spring, a tension spring, or other resilient material. The sliding structure may be a sliding carriage or similar, which is adapted to slide on the inclined plane and thus move away from, or closer to, the portable electrical device in a direction substantially perpendicular to the direction of insertion motion.

In yet another aspect, the sliding carriage maybe supported by a forcer or spring in the first end location, where the spring may urge the carriage in the direction of the first end location when the sliding carriage is in the second end location. The forcer may, for example, take the form of a tension spring, a compression spring, a magnet or a suitable flexible guide contour.

The accommodating entity may be a base station having at least one of a charging appliance or circuitry for data transmission. The mobile electrical device may be, for example, an X-ray detector having a sensor surface which is sensitive to X-ray radiation and a data memory. However, the accommodating entity may be used for charging electrical hand tools, mobile telephones or other portable or mobile electronic devices using batteries. At least one contact pair may be provided for supplying energy to a battery which is located in the electrical device.

Data transmission may be to or from the mobile electrical device. Moreover, the data transmission may take place using the charging contact pair, for example, by generating a data signal which may be modulated onto the charging current. In this way, a single contact pair can suffice for both charging and data transmission.

A mechanism is provided whereby relative sliding movements between contact surface and charging contact surface are substantially eliminated. In order to achieve this, the insertion movement of the portable device is used. During the insertion movement, the unit having the charging contacts is also moved by the movement of the portable at a speed over a slanted plane such that relative motion between the contacts of the two units is minimal. As a result, the charging contacts move perpendicularly towards the contact surfaces of the portable device. Spring-loaded charging contacts are used, or a larger portion of the sliding structure is sprung in order to equalize tolerances. A tension spring may be used so that, when the detector is removed, the charging unit travels back along the slanted plane again. The tension spring can also be replaced by a compression spring, a magnet, a guide contour, or the like, which urges the charging unit to return to a first position.

In a further aspect, the charging unit may be mounted in a fixed manner below the battery which is to be charged. In this arrangement, the charging unit executes the same movement as the battery which is moved, and the contact is established by virtue of the movement on the slanted plane. In addition, the slanted plane may be replaced by a contour or guide which is not straight, or which is regularly or irregularly curved, and which restricts the distance between charging contact and contact surface as a result of the insertion motion.

As a result of using the described mechanism, an additional drive unit may not be required since the insertion movement that is already being performed can be used as a "drive." As a result of the sliding structure charging unit traveling on the slanted plane at an identical speed with the mobile device, there are no relative movements between the contact surfaces of the mobile device and the charging contacts of the charging unit, and hence no significant wear at the contacts. Since the charging unit is moved over a short path, only a short cable track is required.

DESCRIPTION

Exemplary embodiments may be better understood with reference to the drawings, but these examples are not intended to be of a limiting nature. Like numbered elements in the same or different drawings perform equivalent functions. When a specific feature, structure, or characteristic is described in connection with an example, it will be understood that one skilled in the art may effect such feature, structure, or characteristic in connection with other examples, whether or not explicitly stated herein.

Figure 1:
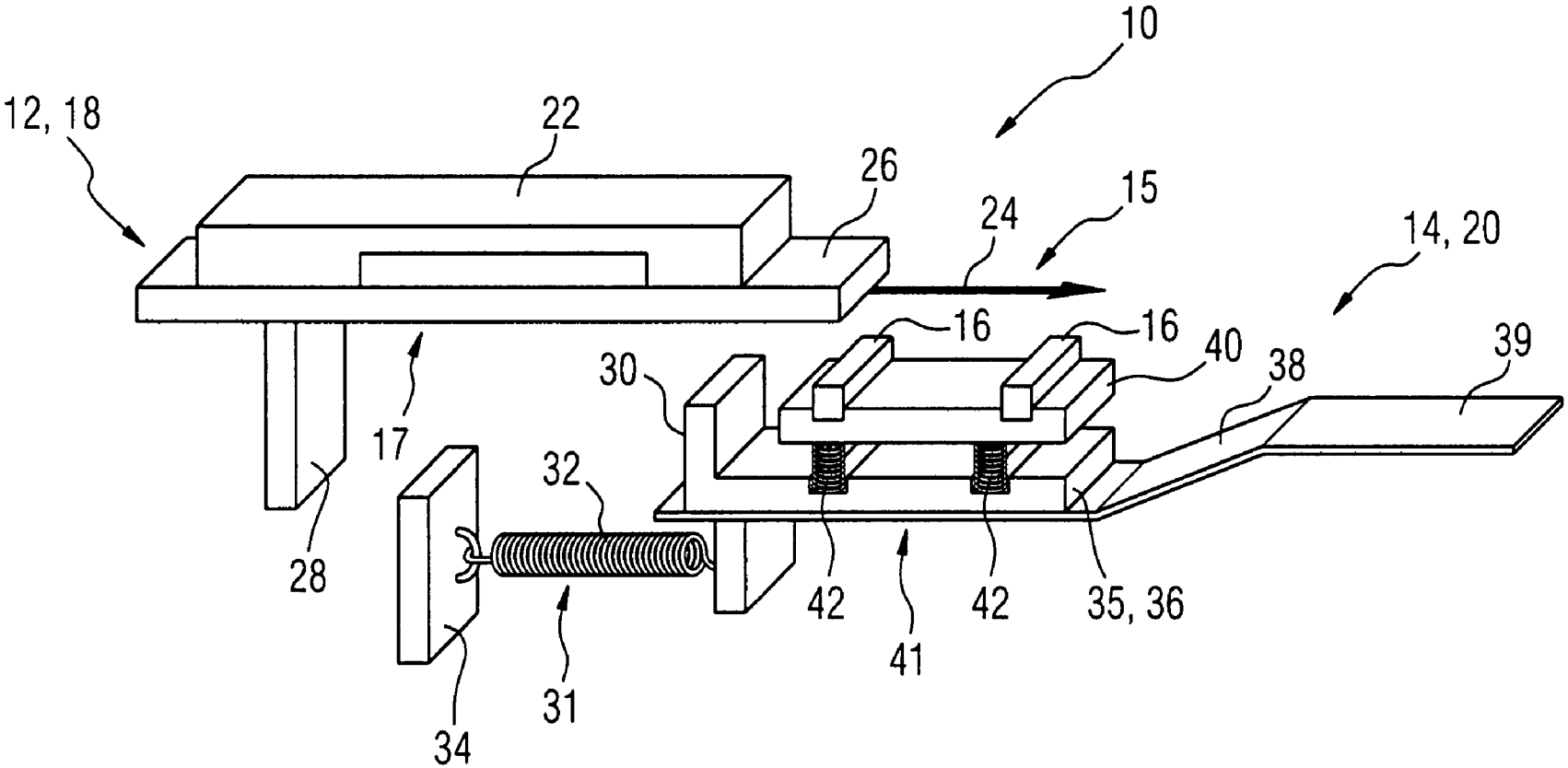
FIG. 1 shows a perspective view of a first embodiment of a contacting appliance.

The perspective view in FIG. 1 shows a first example of a contacting appliance 10 for a mobile electrical device 12 which may be coupled to a suitable accommodating entity 14. Corresponding charging contacts 16 at the accommodating entity 14 and the charging contacts 17 at the device 12 form a contact pair. The contact pair are designated generally by the reference numeral 15, and are brought into electrically conductive contact. The mobile electrical device 12 can be a mobile X-ray detector 18 while the accommodating entity 14 can be a base station or a charging station 20 for supplying energy to a battery 22 of the X-ray detector 18 or of the mobile electrical device 12. The term mobile electrical device should be understood to include any apparatus which may be operated by a battery, and may be transported by any means, such as carried by an individual, attached to a vehicle or the like, and which may be introduced into the accommodating entity 14 for at least one of data communications or battery charging.

FIG. 1 shows the X-ray detector 18, which can be pushed in the direction shown by the horizontal arrow 24, and has an insertion plate 26 as a carrier component. On the underside of the insertion plate 26, charging contacts 17 may be arranged. These charging contacts are not visible in the figure but the location thereof is indicated by an arrow. The charging contacts 17 are arranged in a configuration which corresponds to the charging contacts 16 of the accommodating entity 14, or the charging station 20, and establishes a contact to the charging contacts 16 when the X-ray detector 18 with its stop bracket 28 is pushed against a corresponding locating face 30 of the charging station 20.

The contact pair 15 includes the charging contacts 16 of the accommodating entity 14 and the charging contacts 17 of the mobile electrical device 12. The contact arrangements have at least one contact on each side. An additional ground contact can be established if necessary using a housing contact or other electrical path. Usually, however, the contact pair 15 includes two contact surfaces on each side, as is also indicated graphically in FIGS. 1 to 3.

The contacting unit of the charging station 20 may be pushed in a horizontal direction and is attached in a sprung manner. In this example, a tension spring 32 connects to a housing section 34 of the charging station 20, such that a return force opposing the insertion direction 24 of the X-ray detector 18 is generated. Instead of this tension spring 32, other spring types 31 may also be used.

The charging contacts 16 of the charging station 20 are attached in a sprung manner to a sliding unit 35 having the form of a carriage 36, such that the contacts 16 can move in a vertical direction. The sliding unit 35 or carriage 36 can slide along a plane 38, which is initially horizontal and then inclined obliquely upwards in the insertion direction 24, when the X-ray detector 18 is moved to the second end location. At the second location, the charging contacts 16 and the contacts 17 of the X-ray detector 18 may be connected in an electrically conductive manner, and are pressed together. Following the inclined plane 38 there is another horizontal section 39 at a higher level on which the carriage 36 can slide when the X-ray detector 18 is fully inserted into the charging station 20.

From the position illustrated in FIG. 1, the X-ray detector 18 can be urged rightwards in the insertion direction 24, and the stop bracket 28 initially approaches the locating face 30. When the stop bracket 28 contacts the locating face 30, the carriage 36 is moved rightwards against the return force of the tension spring 32, along with the detector 18, and in a manner which is synchronous relative to the insertion movement thereof. When the carriage 36 reaches the inclined plane 38, the carriage 36 with the charging contacts 16 also begins a vertical movement upwards in the direction of the downward-facing charging contacts 17 of the detector 18.

The charging contacts 16 of the carriage 36 are arranged on a carrier element 40 which is connected, using a forcer or pretension entity 41 having the form of a compression spring 42 or a plurality of compression springs 42, to the carriage 36, such that the carrier element 40 with the charging contacts 16 that are arranged thereon may be continuously pressed upwards in the direction of the charging contacts 17 of the detector 18 or battery 22 thereof. As the detector 18 is pushed still further in the direction of the second insertion position, which may be the inserted end location, the carriage 36 slides further onto the adjoining horizontal section 39 attached to the upper end of the inclined plane 38. The charging contacts 16 of the accommodating entity 14 and 17 of the device 12 may be brought into electrically conductive contact without sliding and hence without wear-inducing relative movement of the contact faces occurring. The contacts 15 are pressed together without a significant sliding motion, and this can take place repetitively without wear.

Figure 2:
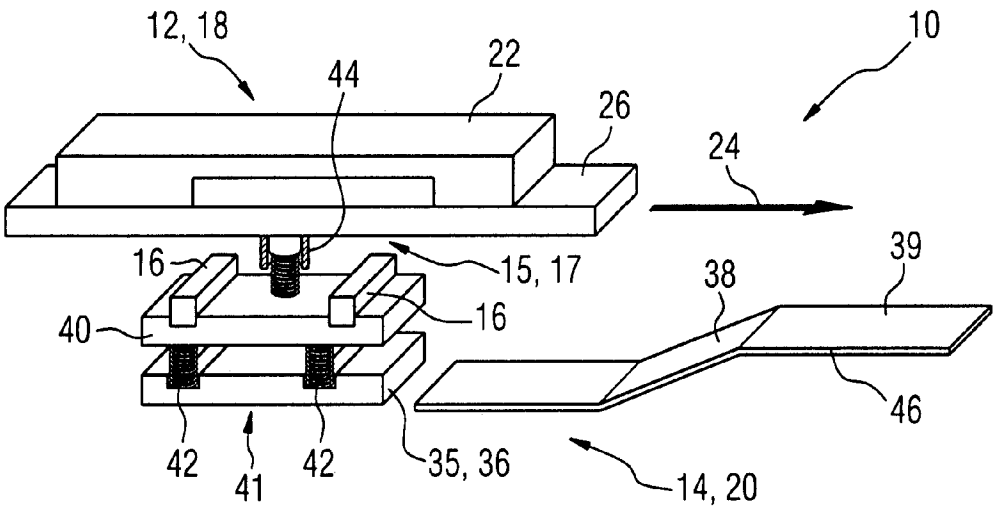
FIG. 2 shows a perspective view of a second embodiment of a contacting appliance.

The perspective view of FIG. 2 shows a second example of the contacting appliance 10, where the electrical device 12 which may be the X-ray detector 18, or the like, may be placed directly onto the charging contacts 16 of the accommodating entity 14. In this configuration, the X-ray detector 18 is placed onto the carriage 36 using a motion in a vertical direction, and a guide 44 may be provided in order to ensure the correct relative positioning of the X-ray detector 18 when establishing electrical contact. The guide 44 may arranged with a compression spring disposed between the contacts 17 of the X-ray detector 18 and the charging contacts 16 of the charging station 20. The spring force of the compression spring may be such that the force is less than the sum of the spring forces of the compression springs 42, which are arranged between the carriage 36 and the carrier element 40.

When the X-ray detector 18 is placed vertically onto the charging station 20, the contact pairs 15 are arranged one above the other and a conductive connection may be made, although an electrical contact is not required in this position. The positioning of the X-ray detector 18 relative to the carriage 36 may not change during the further insertion process in the direction of the fully inserted end location of the detector 18. As a result of pushing the detector 18, and the carriage 36 which is coupled thereto by means of the guide 44, in the insertion direction 24, the carriage 36 slides obliquely upwards over the inclined plane 38, and the charging contacts 16 are pressed more forcefully against the corresponding contacts at the underside of the detector 18. The relative horizontal position of the opposing contacts is not changed when sliding the carriage 36 over the higher horizontal plane 39 of the carriage support 46.

Figure 3:
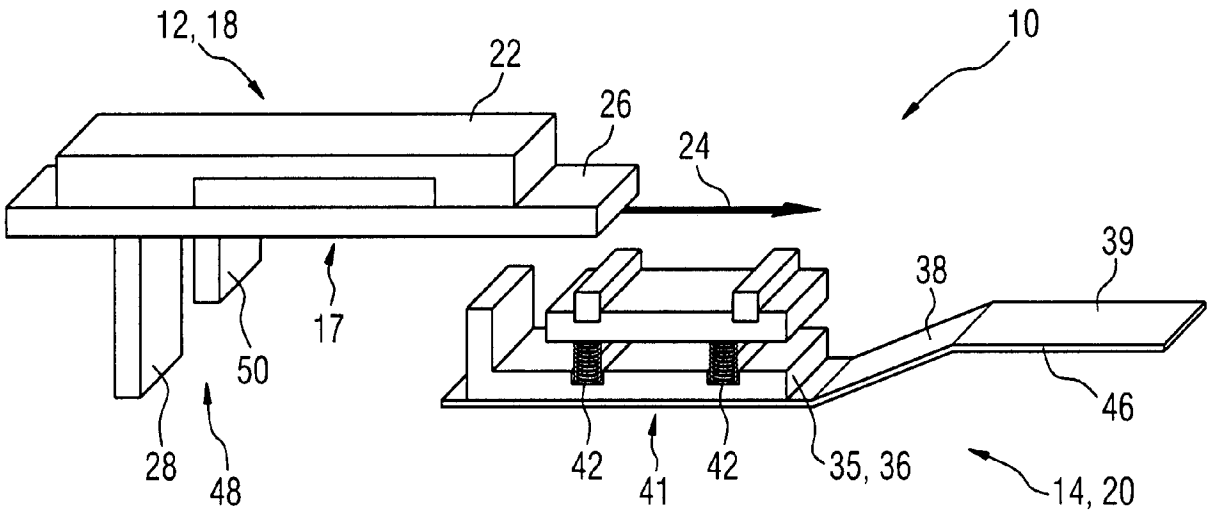
FIG. 3 shows a perspective view of a third embodiment of a contacting appliance.

The perspective view of FIG. 3 shows a third example of the contacting appliance 10, in which the electrical device 12 or the X-ray detector 18 may be coupled to the carriage 36 in a manner which is similar to that of the first example. The third example does not have a tension spring. However, there may be a tension spring, a compression spring, a magnet, a guide contour or another suitable device which urges the return of the carriage 36 of the charging unit 20 to the first position when the device 12 or the X-ray detector 18 is removed.

FIG. 3 shows a guide 48 having a first stop bracket 28 and a shorter second stop bracket 50, which is arranged parallel therewith, on the underside of the detector 18. A locating face 30 is on the carriage 36. The remaining structure of the contacting appliance 10 and of the individual components of the device 12 and the appliance 14 correspond to the first example, and are not further described.

When the detector 18, with the flat insertion plate 26 and the battery 22 which is mounted thereon, is pushed rightwards in the insertion direction 24, the stop bracket 28 arrives at the stop face 30 of the carriage 36 and pushes the carriage 36 rightwards in the direction of the inclined plane 38. As soon as the carriage 36, by virtue of its sliding on the ramp 38, has reached a certain height, or is situated on the horizontal section 39 of the upper carriage support 46, the second stop bracket 50 of the guide 48 engages an opposing side of the stop face 30, such that the stop face 30 is guided in either the forward direction of insertion 24 or the opposite direction therefrom by the two brackets 28 and 50, with little play.

When the device 12 is withdrawn from the second end location, the second stop bracket 50 guides the carriage 36 back along the inclined plane 38 leftwards until the bracket 30 of the carriage 36, which has been moved downwards again, disengages from the shorter bracket 50. The X-ray detector 18 may then be removed from the charging station 20.

As a result of using the described guide mechanism, a separate drive unit is required since the insertion movement can be utilized as a drive. As a result of pushing the carriage 36 on the inclined plane 38 at substantially the same speed as the mobile device 12, there are no significant relative movements between the contact surfaces of the device 12 and the charging contacts 16 of the charging station 14 and hence no wear. Since the carriage unit 36 is only pushed over a short path, only a short cable track is required so as to connect to the remainder of the charging unit 20. When removing or inserting the detector 18, the charging contacts are protected against damage since no sliding contact takes place. The described mechanism for establishing a contact can essentially be used a variety of applications for transmitting data, current and information, including charging a mobile telephone in a charging station.

Although only a few exemplary embodiments of this invention have been described in detail above, those skilled in the art will readily appreciate that many modifications are possible in the exemplary embodiments without materially departing from the novel teachings and advantages of the invention. Accordingly, all such modifications are intended to be included within the scope of this invention as defined in the following claims.

What is claimed is:

1. A contacting appliance for temporarily establishing an electrically conductive contact, the appliance comprising:

an accommodating entity having at least one electrical contact and adapted to receive a device to be contacted wherein the electrical contact and the device to be contacted are jointly movable from a first position to a second position when the device is inserted in the accommodating appliance; and, a relative movement direction of the electrical contact with respect to the device is substantially perpendicular to the insertion direction of the device to be contacted.

2. The contacting appliance of claim 1, wherein the at least one contact of the accommodating entity is assigned to a sliding unit which establishes the location of a first location for a placement position of the device and a second location for an inserted position of the device.

3. A contacting appliance for temporarily establishing an electrically conducive contact, the appliance comprising:

an accommodating entity having at least one electrical contact and adapted to receive a device to be contacted, wherein the electrical contact and the device to be contacted are jointly movable from a first position to a second position when the device is inserted in the accommodating appliance; and, a relative movement direction of the electrical contact is oblique to the insertion direction of the device to be contacted.

4. The contacting appliance of claim 1, wherein a sliding unit slides between the first the and second positions on a sliding plane which is inclined relative to the device insertion direction.

5. The contacting appliance of claim 1, wherein a forcer is disposed between the electrical contact of the accommodating entity and a sliding unit, and a forcer presses the contact of the accommodating entity against a contact of the device when the sliding unit is in the second position.

6. The contacting appliance of claim 5, wherein the forcer is a spring.

7. The contacting appliance of claim 6, wherein the spring is a compression spring.

8. The contacting appliance of claim 6, wherein the position of the sliding unit in the first end position is restrained by a spring, and wherein the spring exercises a return force in the direction of the first position when the sliding unit is in the second position.

9. The contacting appliance of claim 8, wherein the spring is at least one of a tension spring, a compression spring, a magnet, or a guide contour.

10. The contacting appliance of claim 1, wherein the accommodating entity is a base station having at least one of a charging appliance, or electronics for data transmission.

11. A contacting arrangement, comprising:

an accommodating entity having a contacting appliance, the contacting appliance having at least one contact; and an electrical device having at least one contact, wherein contacts of the accommodating entity and the electrical device are arranged facing each other when the electrical device is in a first position of the device at the accommodating entity, and the facing contacts are pressed against each other, substantially without a relative movement therebetween in a second position of the device.

12. The contacting arrangement of claim 11, wherein the facing contacts meet each other when the electrical device is moved between the first position and the second position.

13. The contacting arrangement of claim 11, wherein the at least one contact of the accommodating entity is associated a sliding unit which establishes a first position of the device and a second position of the device, wherein the sliding unit in the second position is disposed closer to the device than in the first position.

14. The contacting arrangement of claim 12, wherein the forcer is arranged between the contact of the accommodating entity and the sliding unit, and presses the contact of the accommodating entity against the contact of the device when the sliding unit is in the second position.

15. The contacting arrangement of claims 11, wherein the electrical device is an X-ray detector having a sensor surface which is sensitive to X-ray radiation and a data memory.

16. The contacting arrangement of claims 11, wherein the contact supplies energy to a battery which is disposed in the device.

17. The contacting appliance of claim 3, wherein a sliding unit is closer to the device in the second position than in the first position.

18. The contacting arrangement of claim 11, wherein the relative movement direction is parallel to contact surfaces of the facing contacts.

19. The contacting arrangement of claim 1, wherein the electrical contact is a plurality of contacts.

* * * * *

UNITED STATES PATENT AND TRADEMARK OFFICE

CERTIFICATE OF CORRECTION

PATENT NO. : 7,507,123 B2
APPLICATION NO. : 12/074397
DATED : March 24, 2009
INVENTOR(S) : Michael Kleber It is certified that error appears in the above-identified patent and that said Letters Patent is hereby corrected as shown below:

In column 7, claim 4, line 36, after "between the first" delete "the and" and substitute --and the-- in its place.

In column 7, claim 8, line 49, before "position is restrained by" delete "end".

Signed and Sealed this

Fourth Day of August, 2009

JOHN DOLL
*Acting Director of the United States Patent and Trademark Office*